US005375830A

United States Patent [19]

Takemoto et al.

[11] Patent Number: 5,375,830

[45] Date of Patent: Dec. 27, 1994

[54] SLOT MACHINE

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 916,993

[22] PCT Filed: Dec. 13, 1991

[86] PCT No.: PCT/JP91/01712

§ 371 Date: Aug. 18, 1992

§ 102(e) Date: Aug. 18, 1992

[87] PCT Pub. No.: WO92/11072

PCT Pub. Date: Sep. 7, 1992

[30] Foreign Application Priority Data

Dec. 19, 1990 [JP] Japan ..... 2-403767
Dec. 19, 1990 [JP] Japan ..... 2-403783

[51] Int. Cl.[5] ..... G07F 17/34
[52] U.S. Cl. ..... 273/143 R
[58] Field of Search ..... 273/138 A, 143 R

[56] References Cited

U.S. PATENT DOCUMENTS 4,695,053 9/1987 Vazquez, Jr. et al. ..... 273/143 R
4,718,672 1/1988 Okada ..... 273/143 R
5,096,195 3/1992 Gimmon ..... 273/138 A

FOREIGN PATENT DOCUMENTS 0064308 11/1982 European Pat. Off. .
2263570 7/1974 Germany .
3820865 12/1989 Germany .
54130590 3/1953 Japan .
WO8605407 9/1986 Japan ..... 273/138 A
63-1581 1/1988 Japan .
63-1587 1/1988 Japan .
63-32470 6/1988 Japan .
64-19486 1/1989 Japan .
1-204686 8/1989 Japan .
1559161 1/1980 United Kingdom .

*Primary Examiner*—Benjamin H. Layno
*Attorney, Agent, or Firm*—Lowe, Price, LeBlanc & Becker

[57] ABSTRACT

A slot machine, which is to be started by inserting tokens into a slot 12 and by activating a game start switch 13 to turn and change a plurality of symbols and then stop the symbols in timed relation with activations of respective stop switches 25*a*, 25*b*, 25*c*, comprises a plurality of liquid crystal displays 20*a*, 20*b*, 20*c* situated on a front side of said slot machine, and display controlling means 31 for controlling said liquid crystal displays 20*a*, 20*b*, 20*c* to display a combination of the symbols. The liquid crystal displays can be reduced in depth, without changing the number and size of symbols. The plural liquid crystal displays can give symbols-on-the-drum ambience. Therefore it is possible not only to increase profits with a limited space of installation of slot machines but also to simplify the planning of an amusement parlor to save time and cost. The slot machine has strong appeal to the player.

11 Claims, 10 Drawing Sheets

SLOT MACHINE

FIELD OF TECHNOLOGY

This invention relates to a slot machine in which a plurality of symbols are to be changed by inserting tokens into a slot and activating a game start switch and are then stopped at preset times.

BACKGROUND TECHNOLOGY

The conventional slot machine of this type is exemplified by Japanese Utility Model Laid-Open Publication No. SHO 54-130590. In this conventional slot machine, tokens or coins are individually inserted into a slot to rotate three drums displaying symbols, and stop switches are then depressed to stop the drums one after another. Depending on the combination of symbols, a predetermined number of tokens are dispensed as a prize.

In another conventional slot machine, a cathode ray tube instead of the rotary drums is situated on a front side of the slot machine and displays symbols in three rows and three columns, i.e., nine symbols in total.

In every amusement parlor, in order to attract many customers to increase profits, it has long been desirable to minimize the space to be occupied by a single game machine so that as many game machines as possible can be installed in the parlor. However, in the former conventional slot machine, since the size of the individual drum is restricted by the size and number of the symbols to be displayed on the drum, reduction of the depth has limits. In the latter slot machine, because of an electron gun used in the cathode ray tube, reduction of the depth also has limits. Consequently in an amusement parlor where both the conventional slot machines and pachinko machines are to be installed, since the depth of the slot machine cannot be reduced down to that of the pachinko machine, all islands of these game machines must be divided into slot machine islands and pachinko machine islands so that planning, designing and construction of the amusement parlor is complex, requiring much time and cost.

Further in the latter slot machine, since symbols are displayed in the form of a single plane on the screen of the cathode ray tube, it lacks the visual appeal and fun, compared to using drums.

DISCLOSURE OF THE INVENTION

With the foregoing problems in mind, it is therefore an object of this invention to provide a slot machine which requires a reduced installation space to increase profits for the amusement parlor and because of which planning, designing and construction of the amusement parlor can be simplified to save time and cost, without impairing visual appeal and fun.

According to a first aspect of this invention, the above object can be accomplished by a slot machine which is to be started by inserting tokens into a slot and by activating a game start switch to turn and change a plurality of symbols and then stop the symbols in timed relation with activations of respective stop switches, the slot machine comprising: a plurality of liquid crystal displays situated on a front side of the slot machine; and display controlling means for controlling the liquid crystal displays to display a combination of the symbols.

Each of the liquid crystal displays may have a front convex surface and may include a plurality of liquid crystal display plates connected to one another at an angle.

The slot machine may further comprise result discriminating means for discriminating whether or not the combination of the stopped symbols coincides with any of predetermined prize winning combinations, the display controlling means being operable to control the liquid crystal displays to display a predetermined result when the result discriminating means discriminates that the combination of the stopped symbols coincides with one of the predetermined prize winning combinations.

The liquid crystal displays may be capable of displaying the predetermined result by flashing the individual symbols of the prize winning combination as discriminated by the result discriminating means or by flashing the background of the last-named individual symbols.

The liquid crystal display may be capable of displaying the predetermined result by flashing frames respectively encircling the individual symbols of the prize winning combination as discriminated by the result discriminating means.

The display controlling means may be capable of controlling each liquid crystal display to display a plurality of the symbols, the prize winning combination being a combination of symbols arranged in a straight line over the crystal displays. The liquid crystal displays are capable of additionally displaying the straight line on which the symbols of the prize winning combination are arranged.

The slot machine may further comprise the display controlling means being capable of controlling each liquid crystal display to display a plurality of the symbols; an identifying unit for identifying whether the token inserted into the slot is genuine or not; prize winning combination setting means for setting a prize winning combination, from a plurality of predetermined combinations of symbols to be arranged in the straight line, depending on the number of inserted tokens identified as being genuine by the discriminating unit; result discriminating means for discriminating whether or not the combination of stopped symbols coincides with the prize winning combination set by the prize winning combination setting means; prize token dispensing means for dispensing tokens as a prize when the result discriminating means discriminates the coincidence of the combination of stopped symbols with the prize winning combination; and the display controlling means being capable of controlling the liquid crystal displays to display a line in which the stopped symbols are a prize winning combination set by the prize winning combination setting means.

The slot machine may further include means for generating sound or vibration in response to the discrimination of the result discriminating means.

According to a second aspect of the invention, each liquid crystal display may be divided into a liquid crystal front display and a liquid crystal symbol display. In this case, each liquid crystal front display is situated in front of the respective symbol and is partially changeable between shielding light and transmitting light. Front display controlling means is operatively connected with the liquid crystal front display for controlling the liquid crystal front display to make a predetermined display. The front display controlling means may be capable of controlling the liquid crystal front displays to make the predetermined display when the combination of stopped symbols coincides with the prize winning combination as discriminated by the result discriminating means.

The liquid crystal front displays may be capable of additionally displaying flashing frames encircling positions corresponding to the respective symbols of the prize winning combination as discriminated by the result discriminating means.

The front display controlling means may be capable of controlling each liquid crystal front display to display a plurality of the symbols simultaneously, the prize winning combination being a combination of symbols arranged in a straight line over the crystal displays. The liquid crystal front displays may be capable of additionally displaying the straight line on which the symbols of the prize winning combination are arranged.

Each liquid crystal front display may be capable of displaying a plurality of the symbols simultaneously. The slot machine may further comprise: an identifying unit for identifying whether the token inserted into the slot is genuine or not, prize winning combination setting means for setting a prize winning combination, from a plurality of predetermined combinations of symbols to be arranged in the straight line, depending on the number of inserted tokens identified as being genuine by the discriminating unit; result discriminating means for discriminating whether or not the combination of stopped symbols coincides with the prize winning combination set by the prize winning combination setting means; prize token dispensing means for dispensing tokens as a prize when the result discriminating means discriminates the coincidence of the combination of stopped symbols with the prize winning combination; and the front display controlling means being capable of controlling the liquid crystal displays to display a line in which the stopped symbols are those of a prize winning combination set by the prize winning combination setting means.

With this arrangement, when tokens are inserted into the slot and then the game start switch is activated, symbols displayed on the plural liquid crystal displays are changed by the display controlling means, and this symbol change is stopped in timed relation upon activation of the respective stop switches. Partly since there are a plurality of liquid crystal displays and partly since the liquid crystal displays can be reduced in depth without varying the number and size of the symbols, it is possible to give a symbols-on-the-drum realism.

If each liquid crystal display is convex on the front, it is possible to give an even greater symbols-on-the-drum realism.

If the display controlling means is capable of controlling each liquid crystal display to make a result display or has the sound generating means, it is possible to make the game much more fun.

Under the control of the front display controlling means, the liquid crystal front display is partially changeable between shielding light and transmitting light and then makes a predetermined display.

Further if the display controlling means is capable of controlling the liquid crystal display to display a line in which the symbols of the prize winning combination are to be arranged, it is easy to grasp the prize winning arrangement.

PREFERRED EMBODIMENTS OF THE INVENTION

A first embodiment of this invention will now be described with reference to FIGS. 1 through 7.

Figure 2:
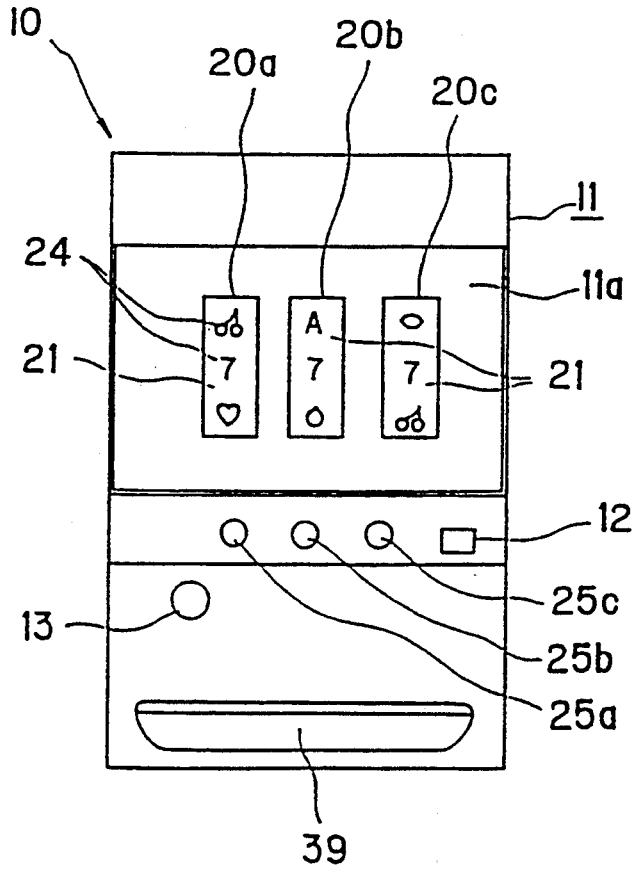
FIG. 2 is a front view of the slot machine of the first embodiment.
Figure 3:
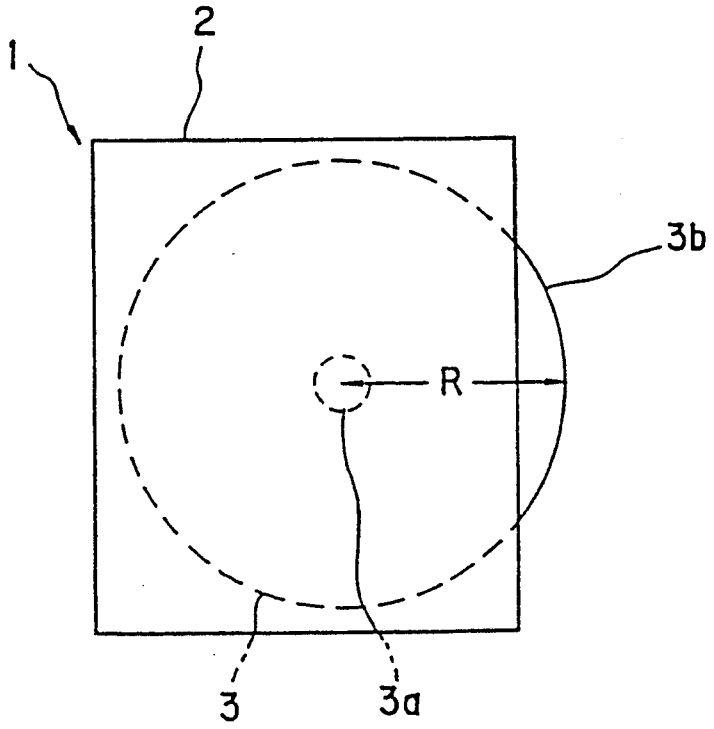
FIG. 3 is a side view of a drum of the slot machine, illustrating a radius of curvature of the liquid crystal display.
Figure 4:
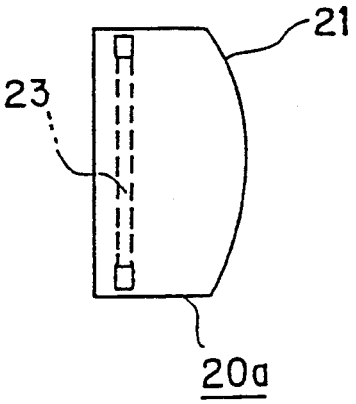
FIG. 4 is a side view of the liquid crystal display.

As shown in FIG. 2, a slot machine 10 has three vertically elongated liquid crystal displays 20*a*, 20*b*, 20*c* arranged laterally on a front surface 11*a* of a box-like frame 11. As shown in FIG. 3, inside a frame 2 of an ordinary slot machine 1, drums 3 displaying symbols are supported inside a frame 2 of an ordinary slot machine 1 via their common central shaft 3*a*, with a portion 3*b* of the individual drum 3 protruding from the frame 2 so as to be seen by the player. Each liquid crystal display 20*a*, 20*b*, 20*c* has, as shown in FIG. 4, a convex display portion 21 whose radius of curvature R is equal to the radius of curvature R of the protruding drum portion 3*b*.

Figure 5:
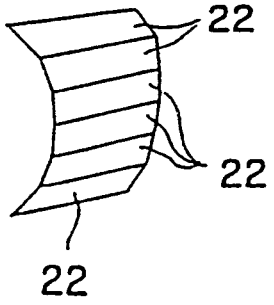
FIG. 5 is a perspective view of liquid crystal display plates of the liquid crystal display.
Figure 8:
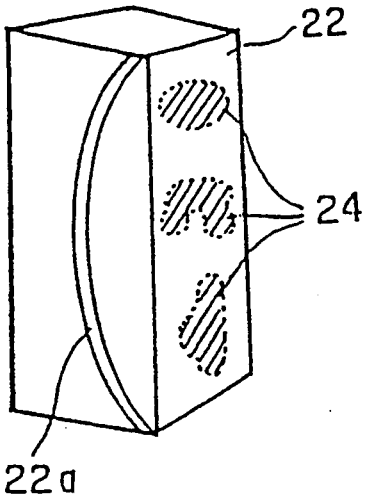
FIG. 8 is a perspective view of a modified liquid crystal display.

Alternatively, each liquid crystal display 20*a*, 20*b*, 20*c* may be composed of a plurality of liquid crystal display plates 22 connected to one another at an angle, as shown in FIG. 5. The uppermost and lowermost liquid crystal display plates 22 of each liquid crystal display 20*a*, 20*b*, 20*c* are adjusted in angle of inclination so as not to be difficult to see from the front side. In another alternative form, each liquid crystal display 20*a*, 20*b*, 20*c* may be in the form of a flat liquid crystal display plate 22 with a concave surface 22*a* situated there behind to give a cubic touch, as shown in FIG. 8.

Inside the liquid crystal display 20*a*, 20*b*, 20*c* there is a back lamp 23 (FIG. 4) behind the display portion 21. The back lamp 23 serves to illuminate the display portion 21 from the reverse side so that the symbols 24 to be displayed on the display portion 21 can be seen brightly from the front-side.

Under the liquid crystal displays 20*a*, 20*b*, 20*c*, there are situated three stop switches 25*a*, 25*b*, 25*c* in association with the respective liquid crystal displays 20*a*, 20*b*, 20c. Each stop switch 25a, 25b, 25c serves to select a timing to stop changing the symbols 24 of the associated liquid crystal display 20a, 20b, 20c. On the front surface 11a of the frame 11, there are a slot 12, into which a token as a game medium is to be inserted, and a game start switch 13. Inside the slot machine 10 there is mounted an identifying unit 14 for identifying whether a token inserted into the slot 12 is genuine or not.

Figure 6:
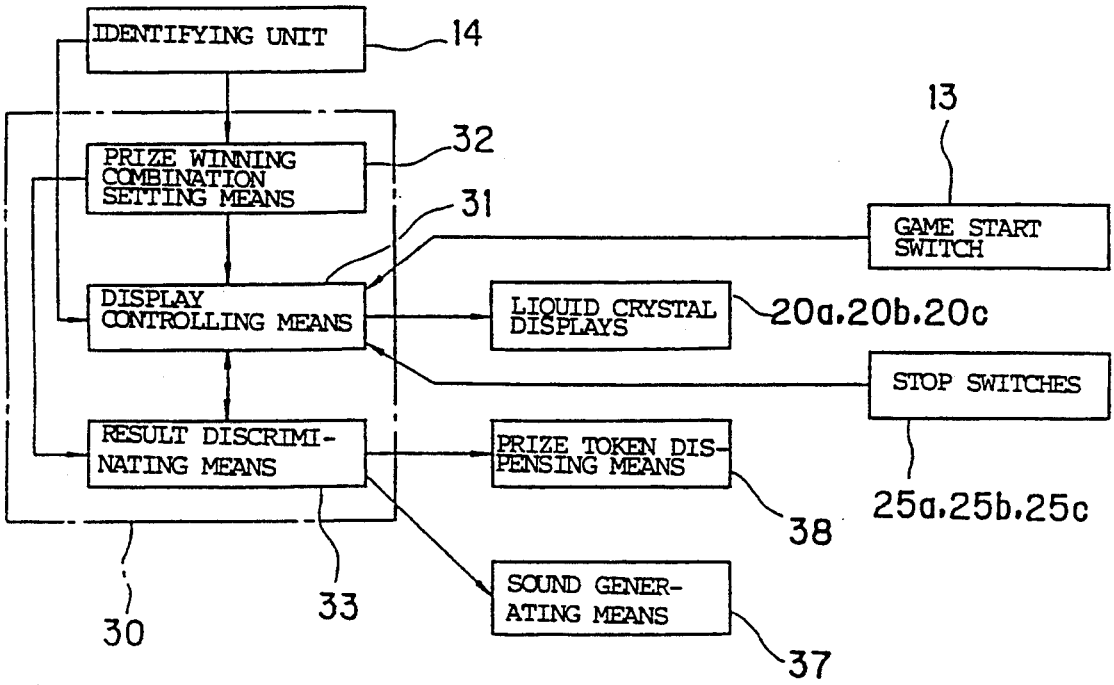
FIG. 6 is a block diagram showing the functions of the slot machine of the second embodiment.

Inside the slot machine 10 there is also mounted a control unit 30. As shown in FIG. 6, the control unit 30 includes a display controlling means 31, a prize winning combination setting means 32 and a result discriminating means 33.

The display controlling means 31 displays, upon activation of the game start switch 13 after the inserted tokens have been identified as being genuine by the identifying unit 14, a plurality of kinds of symbols 24, such as pictures, emblems, numbers and characters, changing successively as if flowing vertically. The display controlling means 31 controls the three liquid crystal displays 20a, 20b, 20c to stop changing the symbols 24 at preset stopping times, i.e., at timings selected by activations of the associated stop switches 25a, 25b, 25c.

Further the display controlling means 31 controls the liquid crystal displays 20a, 20b, 20c to also display a line 35 in which the symbols of a prize winning combination as preset by the prize winning combination setting means 32 have been arranged.

When the result discriminating means 33 discriminates a combination of the stopped symbols to coincide with one of the preset prize winning combinations, the display controlling means 31 controls the liquid crystal displays 20a, 20b, 20c to also make a predetermined result display. This result display may be made by flashing the line 35 in which the symbols 24 of the prize winning combination as discriminated by the result discriminating means 33, or the background 26 of each symbol 24 of the prize winning combination as discriminated by the result discriminating means 33, or the frame 36 surrounding each symbol 24 of the prize winning combination as discriminated by the result discriminating means 33, are arranged individually or in any combination.

The prize winning combination setting means 32 sets at least one prize winning combination from a plurality of predetermined combinations, in each of which symbols 24 are arranged in a straight line, depending on the number of tokens identified as being genuine by the identifying unit 14.

Figure 7A:
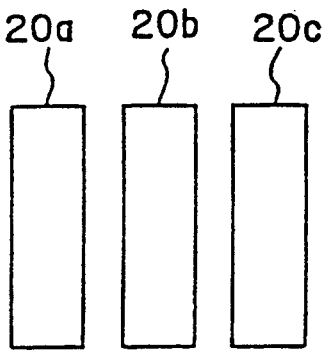
FIGS. 7(A), 7(B), 7(C) and 7(D) are schematic front views each showing the liquid crystal displays which display symbols of a prize winning combination.
Figure 7B:
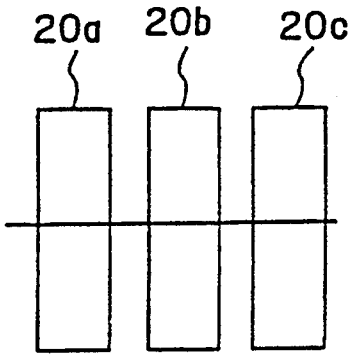
Figure 7C:
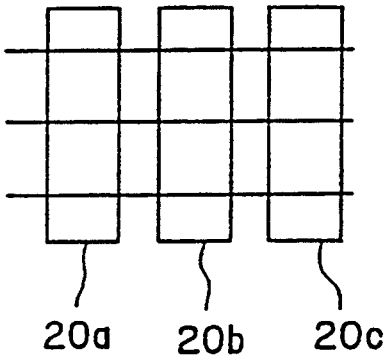
Figure 7D:
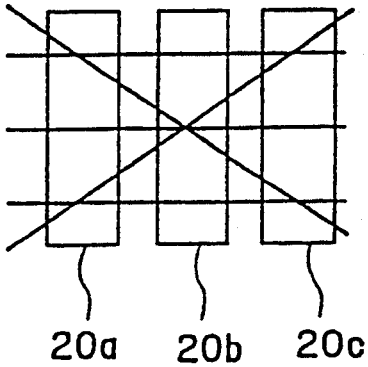

When no token is inserted, no prize winning combination is set over the three liquid crystal displays 20a, 20b, 20c, as shown in FIG. 7(A). When a single token inserted is identified as being genuine by the identifying unit 14, there will be set one horizontal prize winning combination of three symbols 24 such as "7" to be arranged horizontally across the three liquid crystal displays 20a, 20b, 20c at the middle only, as shown in FIG. 7(B). When two tokens inserted are identified as being genuine, there will be set three horizontal prize winning combinations each including three symbols 24 to be arranged horizontally across the three liquid crystal displays 20a, 20b, 20c at the top, middle and bottom, as shown in FIG. 7(C). When three tokens inserted are identified as being genuine, there will be set three horizontal prize winning combinations each including three symbols 24 to be arranged horizontally across the three liquid crystal displays 20a, 20b, 20c at the top, middle and bottom, and two diagonal prize winning combinations, one including three symbols 24 to be arranged diagonally across the top of the left liquid crystal display 20a, the middle of the central liquid crystal display 20b and the bottom of the right liquid crystal display 20c and the other including three symbols 24 to be arranged diagonally across the bottom of the left liquid crystal display 20a, the middle of the central liquid crystal display 20b and the top of the right liquid crystal display 20c, as shown in FIG. 7(D).

The result discriminating means 33 discriminates whether or not a combination of the stopped symbols coincides with any of the predetermined prize winning combinations set by the prize winning combination setting means 32.

A sound generating means 37 is mounted inside the box-like frame 11. The sound generating means 37 generates, in response to the discrimination of the result discriminating means 33, a sound notifying that there has been discriminated a combination of the stopped symbols coincident with a predetermined prize winning combination.

Further a prize token dispensing means 38 is mounted inside the box-like frame 11. When the result discriminating means 33 discriminates a combination of the stopped symbols coincident with a prize winning combination, the prize token dispensing means 38 dispenses a plurality of tokens as a prize into a front tray 39 situated at a front lower portion of the box-like frame 11.

In the control unit 30, the respective functions of the display controlling means 31, the prize winning combination setting means 32 and the result discriminating means 33 may be realized by using a programmable microcomputer or the like. Assuming that a microcomputer is used, the control unit 30 may include a CPU, a ROM, a RAM, an interface, etc.

The operation of the slot machine according to the first embodiment will now be described.

For playing a game, a number of tokens depending on the prize winning combinations to be set are inserted into the slot 12. Specifically, if only one prize winning combination of FIG. 7(B) is to be set, a single token is inserted; if three prize winning combinations of FIG. 7(C) are to be set, two tokens are inserted; and if five prize winning combinations of FIG. 7(D) are to be set, three tokens are inserted.

Figure 1A:
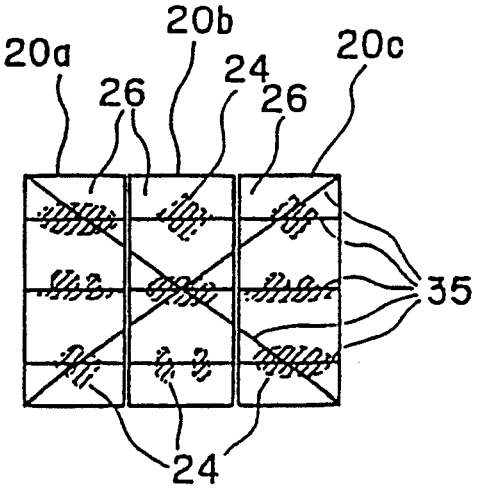
FIGS. 1(A) and 1(B) are schematic front views each showing liquid crystal displays of a slot machine according to a first embodiment of this invention, the liquid crystal displays displaying a prize winning combination of symbols.
Figure 1B:
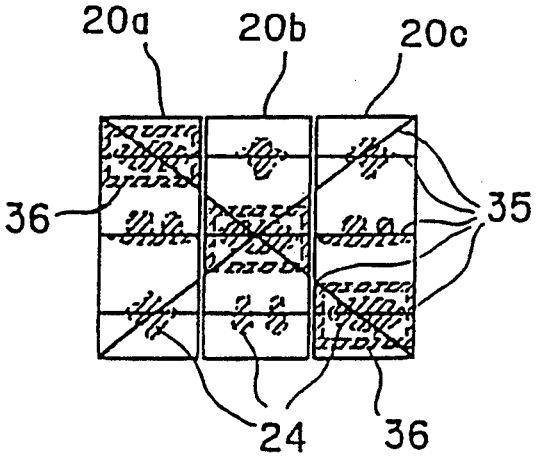

When the inserted tokens are identified as being genuine by the identifying unit 14, the prize winning combinations will be set according to the number of the thus identified tokens by the prize winning combination setting means 32 and, at the same time, the display controlling means 31 will display the lines 35 across the liquid crystal displays 20a, 20b, 20c as shown in FIG. 1(A). These lines 35 will be displayed according to thick lines of FIGS. 7(B), 7(C) and 7(D). In the absence of any inserted token, no line 35 will be displayed across the liquid crystal displays 20a, 20b, 20c.

Then when the game start switch 13 is depressed, the display controlling means 31 controls the three liquid crystal displays 20a, 20b, 20c to display a plurality of kinds of symbols changing successively as if flowing vertically.

At that time, when the stop switches 25a, 25b, 25c are depressed, the changing of the symbols 24 on the liquid crystal displays 20a, 20b, 20c will be stopped in timed relation with the activations of the corresponding stop switches.

When one or more combinations of the stopped symbols coincide with one or more prize winning combinations, namely, when the symbols 24 of the prize winning combination are displayed overlapping the line 35 to be displayed across the liquid crystal displays 20*a*, 20*b*, 20*c*, the prize token dispensing means 38 will dispense tokens as a prize into the front tray 39 in response to the discrimination of the result discriminating means 33 and, at the same time, the sound generating means 37 will generate a sound notifying that the prize tokens have been dispensed. The display controlling means 31 controls the liquid crystal displays 20*a*, 20*b*, 20*c* to display a predetermined scoring result, thus making the game much more fun. Specifically, the predetermined scoring result may be made by flashing the line 35 in which the symbols 24 of the prize winning combination as discriminated by the result discriminating means 33, or the background 26 of each symbol 24 of the prize winning combination as discriminated by the result discriminating means 33, or the frame 36 surrounding each symbol 24 of the prize winning combination as discriminated by the result discriminating means 33 are arranged individually or in any combination. This flashing would notify of every scoring arrangement of symbols much more markedly, inciting the player's gambling spirit.

If there is no combination of the stopped symbols 24 coinciding with any prize winning combination, no prize token will be dispensed, no scoring result display will be made and no sound will be generated.

Since the liquid crystal displays 20*a*, 20*b*, 20*c*, unlike the drums 3 of the prior art, can be reduced in depth without varying the number and size of the symbols 24, it is possible to reduce the depth of the slot machine 10 itself. Therefore the size, such as depth and width, of the slot machine can be conformed with the size of an ordinary pachinko machine, and it is possible to install the slot machines 10 and pachinko machines in the same island, thus simplifying planning, designing and construction of an amusement parlor.

The three liquid crystal displays 20*a*, 20*b*, 20*c*, unlike the cathode ray tube which displays symbols on a single screen, make it possible to give a symbols-on-the-drums realism. Further, partly since each liquid crystal display 20*a*, 20*b*, 20*c* is convex with a radius of curvature equal to the radius of curvature R of the drum 3 and partly since symbols are changed successively as if flowing vertically along such a convex display surface, it is possible to produce an illusion and power as if drums are rotating.

Although the number of the liquid crystal displays is three in this embodiment, it may be any other number more than one.

Further each liquid crystal display may be a convex unitary form without using a plurality of liquid crystal display plates. Alternatively each liquid crystal display may be a flat plate with a concave panel surface so that the liquid crystal display surface starts out of the panel surface.

The stop timing may be selected in response to the activation of the respective stop switch or may be selected automatically after the lapse of a constant time from the start of changing symbols.

The scoring result display may be made by flashing the symbols themselves rather than the background of the symbols.

When no token is inserted, all the lines to be displayed may be displayed or the lines displayed in the previous game may remain on display. The sound to be generated by the sound generating means may be a voice saying a word or words. The sound generating means .may generate, when no scoring result is made, a sound notifying of that fact or a voice saying, for instance, "miss".

FIGS. 9 through 12 show a second embodiment of this invention.

Generally in a conventional slot machine, the number of prize winning combinations varies according to the number of tokens inserted. Specifically, when a single token is inserted, the same kind of symbols will be arranged horizontally across three drums at the middle. When two tokens are inserted, the same kind of symbols will be arranged horizontally across the three drums at the top, the middle or the bottom. When three tokens are inserted, the same kinds of symbols will be arranged horizontally across the three drums at the top, the middle or the bottom, or diagonally across the three drums. To show top, middle and bottom horizontal arrangements and diagonal arrangements, lines along the respective arrangements are described on a front glass cover situated in front of the drums.

However, with this conventional slot machine, when the same kind of symbols are arranged in a line as a prize winning combination, only prize tokens are dispensed, making the game less exciting.

Further with this conventional slot machine, since the lines showing the prize winning combinations are fixed irrespective of the number of tokens inserted, it is difficult to grasp the prize winning arrangement, making the game less exciting.

Figure 10:
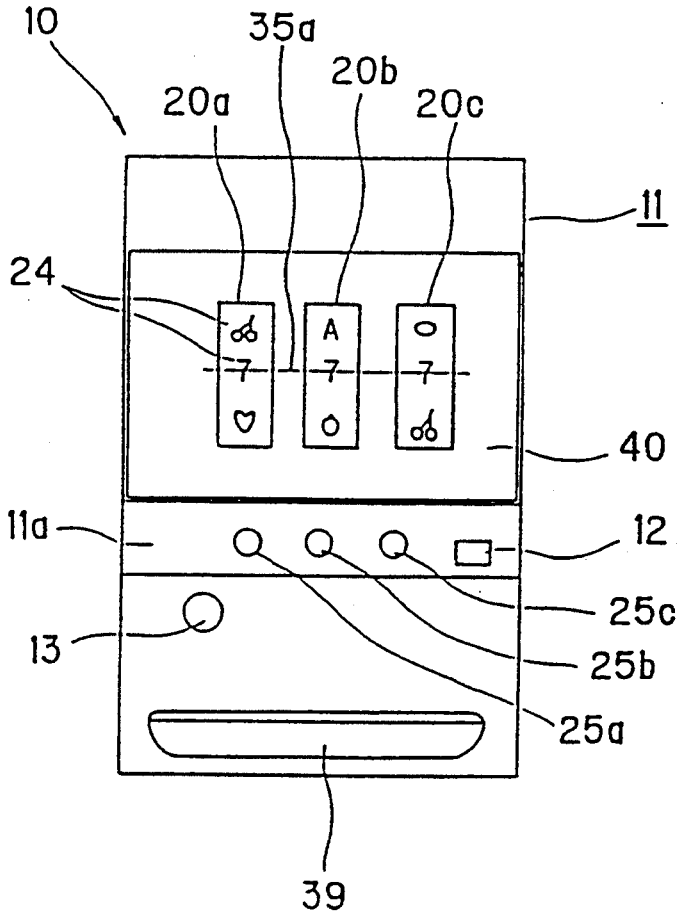
FIG. 10 is a front view of the slot machine of the second embodiment.

With these conventional problems in view, the object of the second embodiment is to provide a slot machine in which the scoring result, the line along a prize winning arrangement, etc. can be displayed, making the game sophisticated and hence much more exciting. As shown in FIG. 10, the slot machine 10 of this embodiment has three vertically elongated liquid crystal symbol displays 20*a*, 20*b*, 20*c* arranged horizontally on the front surface 11*a* of a box-like frame 11. Each liquid crystal symbol display 20*a*, 20*b*, 20*c* displays symbols 24 which are brightly lit.

A liquid crystal front display 40 is situated in front of the liquid crystal symbol displays 20*a*, 20*b*, 20*c*. The liquid crystal front display 40 is a liquid crystal glass plate which is normally transmitting light and is changeable, in response to the flow of a current therethrough, to partially shield light.

Under the respective liquid crystal symbol displays 20*a*, 20*b*, 20*c*, three stop switches 25*a*, 25*b*, 25*c* are situated in association therewith. The stop switches 25*a*, 25*b*, 25*c* are stop buttons for selecting timings to stop changing symbols 24 on the liquid crystal symbol displays 20*a*, 20*b*, 20*c*. On the front surface 11*a* of the box-like frame 11, a slot 12 in which tokens are to be inserted and a game start switch 13 are situated. Inside the slot machine 10 there is mounted an identifying unit 14 for identifying whether a token inserted into the slot is genuine or not.

Figure 11:
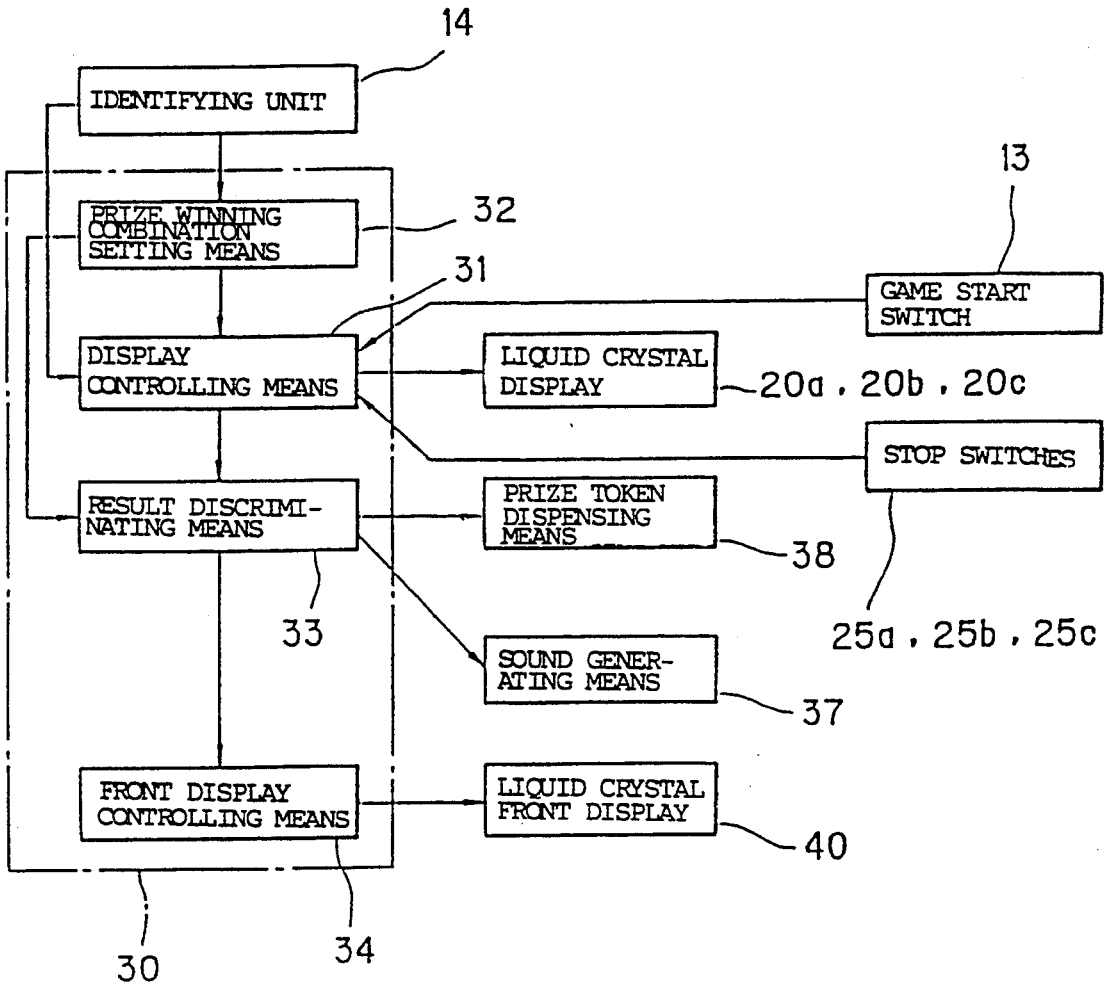
FIG. 11 is a block diagram showing the functions of the slot machine of the second embodiment.

Further a control unit 30 of FIG. 11 is mounted inside the slot machine 10. The control unit 30 includes a symbol display controlling means 31, a prize winning combination setting means 32, a result discriminating means 33 and a front display controlling means 34.

When the identifying unit 14 identifies the inserted tokens as being genuine, the symbol display controlling means 31 controls, in response to the activation of the game start switch 14, the three individual liquid crystal symbol displays 20*a*, 20*b*, 20*c* to display a plurality of kinds of symbols 24, such as pictures, emblems, numbers and characters, changing successively as if sliding vertically. The symbol display controlling means 31 controls the three liquid crystal displays 20*a*, 20*b*, 20*c* to stop changing the symbols 24 at preset stopping times, i.e., at timings selected by activations of the associated stop switches 25*a*, 25*b*, 25*c*.

The prize winning combination setting means 32 sets at least one prize winning combination from a plurality of predetermined combinations, in each of which symbols 24 are arranged in a straight line, depending on the number of tokens identified as being genuine by the identifying unit 14.

The result discriminating means 33 discriminates whether or not a combination of the stopped symbols coincides with any of the predetermined prize winning combinations set by the prize winning combination setting means 32.

The front display controlling means 34 controls the liquid crystal front display 40 to display, in front of the symbols 24, a line 35*a*–35*e* along which the symbols 24 of a prize winning combination are arranged.

When the result discriminating means 33 discriminates a combination of the stopped symbols to coincide with one of the preset prize winning combinations, the display controlling means 31 controls the liquid crystal front display 40 to also make a predetermined result display. This result display may be made by flashing the line 35*a*–35*e* in which the symbols 24 of the prize winning combination as discriminated by the result discriminating means 33, or the background 26 of each symbol 24 of the prize winning combination as discriminated by the result discriminating means 33, or the frame 36 surrounding each symbol 24 of the prize winning combination as discriminated by the result discriminating means 33 are arranged individually or in any combination.

Figure 12A:
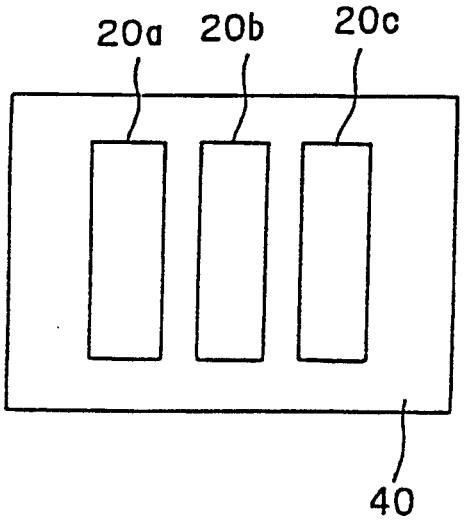
FIGS. 12(A), 12(B), 12(C) and 12(D) are schematic front views each showing the liquid crystal symbol displays which display symbols of a prize winning combination.
Figure 12B:
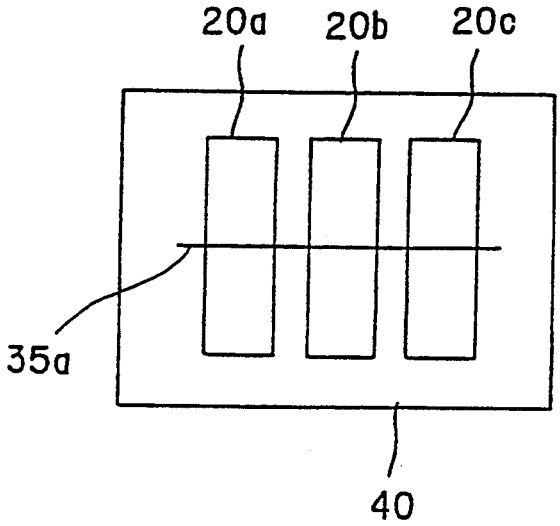
Figure 12C:
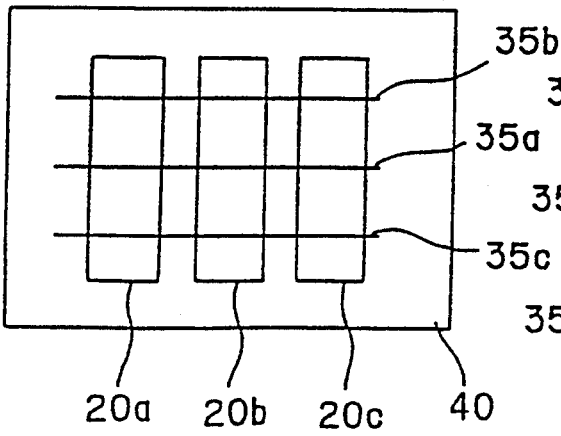

When no token is inserted, no prize winning combination is set over the three liquid crystal symbol displays 20*a*, 20*b*, 20*c*, as shown in FIG. 12(A). When a single token inserted is identified as being genuine by the identifying unit 14, there will be set one horizontal prize winning combination of three symbols 24 such as "7" to be arranged horizontally across the three liquid crystal symbol displays 20*a*, 20*b*, 20*c* at the middle only, as shown in FIG. 12(B). When two tokens inserted are identified as being genuine, there will be set three horizontal prize winning combinations each including three symbols 24 to be arranged horizontally across the three liquid crystal symbol displays 20*a*, 20*b*, 20*c* at the top, middle and bottom, as shown in FIG. 12(C).

Figure 12D:
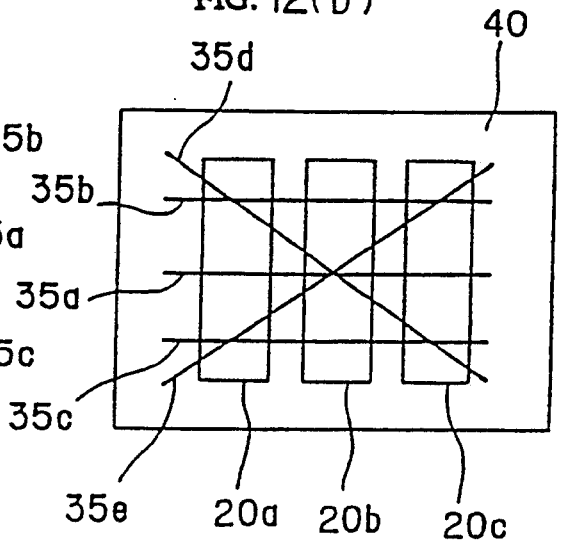

When three tokens inserted are identified as being genuine, there will be set three horizontal prize winning combinations each including three symbols 24 to be arranged horizontally across the three liquid crystal symbol displays 20*a*, 20*b*, 20*c* at the top, middle and bottom, and two diagonal prize winning combinations, one including three symbols 24 to be arranged diagonally across the top of the left liquid crystal symbol display 20*a*, the middle of the central liquid crystal symbol display 20*b* and the bottom of the right liquid crystal symbol display 20*c* and the other including three symbols 24 to be arranged diagonally across the bottom of the left liquid crystal symbol display 20*a*, the middle of the central liquid crystal symbol display 20*b* and the top of the right liquid crystal symbol display 20*c*, as shown in FIG. 12(D).

A sound generating means 37 is mounted inside the box-like frame 11. The sound generating means 37 generates, in response to the discrimination of the result discriminating means 33, a sound notifying that there has been discriminated a combination of the stopped symbols coincident with a predetermined prize winning combination.

Further a prize token dispensing means 38 is mounted inside the box-like frame 11. When the result discriminating means 33 discriminates a combination of the stopped symbols coincident with a prize winning combination, the prize token dispensing means 38 dispenses a plurality of tokens as a prize into a front tray 39 situated at a front lower portion of the box-like frame 11.

In the control unit 30, the respective functions of the symbol display controlling means 31, the prize winning combination setting means 32, the result discriminating means 33 and the front display controlling means 34 may be realized by using a programmable microcomputer or the like. Assuming that a microcomputer is used, the control unit 30 may include a CPU, a ROM, a RAM, an interface, etc.

The operation of the slot machine according to the second embodiment will now be described.

For playing a game, a number of tokens depending on the prize winning combinations to be set are inserted into the slot 12. Specifically, if only one prize winning combination of FIG. 12(B) is to be set, a single token is inserted; if three prize winning combinations of FIG. 12(C) are to be set, two tokens are inserted; and if five prize winning combinations of FIG. 12(D) are to be set, three tokens are inserted.

Figure 9A:
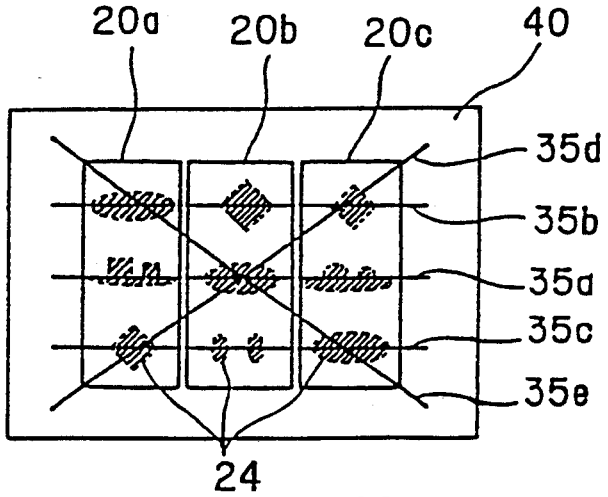
FIGS. 9(A) and 9(B) are schematic front views each showing liquid crystal symbol displays of a slot machine according to a second embodiment of the invention, the liquid crystal symbol displays displaying symbols of a prize winning combination.
Figure 9B:
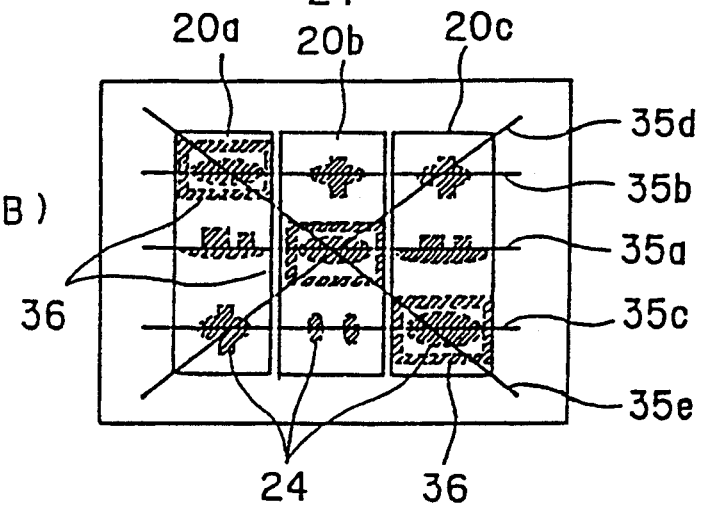

When the inserted tokens are identified as being genuine by the identifying unit 14, the prize winning combinations will be set according to the number of the thus identified tokens by the prize winning combination setting means 32 and, at the same time, the front display controlling means 34 will display the lines 35*a*–35*e* across the liquid crystal front display 40 as shown in FIG. 9(A). The liquid crystal front display 40 normally transmits light so that the symbols 24 on the liquid crystal symbol displays 20*a*, 20*b*, 20*c* are allowed to be seen from the front side, and is changeable, in response to the flow of a current therethrough when the displaying is to be displayed under the control of the front display controlling means 34, to partially shield light to make a predetermined display in front of the symbols. These lines 35*a*–35*e* will be displayed according to thick lines of FIGS. 12(B), 12(C) and 12(D). In the absence of any token being inserted, no line 35*a*–35*e* will be displayed across the liquid crystal front display 40.

Then when the game start switch 13 is depressed, the symbol display controlling means 31 controls the three liquid crystal symbol displays 20*a*, 20*b*, 20*c* to display a plurality of kinds of symbols changing successively as if sliding vertically, from top to bottom or from bottom to top.

At that time, when .the stop switches 25*a*, 25*b*, 25*c* are depressed, the changing of the symbols 24 on the liquid crystal symbol displays 20*a*, 20*b*, 20*c* will be stopped in timed relation with the activations of the corresponding stop switches.

When one or more combinations of the stopped symbols coincide with one or more prize winning combinations, namely, when the symbols 24 of the prize winning combination are displayed overlapping the line 35*a*–35*e* to be displayed across the liquid crystal front display 40, the prize token dispensing means 38 will dispense tokens as a prize into the front tray 39 in response to the discrimination of the result discriminating means 33 and, at the same time, the sound generating means 37 will generate a sound notifying that the prize tokens have been dispensed. The front display controlling means 34 controls the liquid crystal symbol display 40 to display a predetermined scoring result, thus making the game much more fun. Specifically, the predetermined scoring result may be made by flashing the line 35*a*–35*e* in which the symbols 24 of the prize winning combination as discriminated by the result discriminating means 33, or the background 26 of each symbol 24 of the prize winning combination as discriminated by the result discriminating means 33, or the frame 36 surrounding each symbol 24 of the prize winning combination as discriminated by the result discriminating means 33 are arranged individually or in any combination. This flashing would notify of every scoring arrangement of symbols much more markedly, inciting the player's gambling spirit.

If there is no combination of the stopped symbols 24 coinciding with any prize winning combination, no prize token will be dispensed, no scoring result display will be made and no sound will be generated.

Since the liquid crystal symbol displays 20*a*, 20*b*, 20*c*, unlike the drums 3 of the prior art, can be reduced in depth without varying the number and size of the symbols 24, it is possible to reduce the depth of the slot machine 10 itself.

Although the number of the liquid crystal displays three in this embodiment, it may be any other number more than one.

Further in the second embodiment, the symbol display is a liquid crystal glass plate. Alternatively an ordinary rotating drum having symbols on its circumferential surface may be used.

The stop timing may be selected in response to the activation of the respective stop switch or may be selected automatically after the lapse of a constant time from the start of changing symbols.

When no token is inserted, all the lines to be displayed may be displayed or the lines displayed in the previous game may remain on display. The sound to be generated by the sound generating means may be a voice saying a word or words. The sound generating means may generate, when no scoring result is made, a sound notifying of that fact.

In addition to the sound generating means, a vibration generating means may be provided in order to increase power when a scoring arrangement is made.

USEFULNESS OF THE INVENTION

According to the slot machine of this invention, since it can be reduced in depth by using a plurality of liquid crystal displays in displaying symbols, it is possible to reduce the space of installation of a game machine to increase profits. In particular if it is designed to be the same size as a pachinko machine, it is possible to simplify planning, designing and construction of an amusement parlor, which can save time and cost therefor. Since each liquid crystal display is composed of a plurality of liquid crystal display plates, it is possible to give the appearance and power as if using real drums.

When a scoring result and a line are displayed on the liquid crystal displays, it is possible to make the game much more exciting.

In the case of using the liquid crystal front display, since a predetermined display such as a scoring result display and a line display along a scoring arrangement can be made in front of the symbols, it is possible to make the game much more sophisticated and hence much more exciting. Further when the liquid crystal front display makes a scoring result display and when the sound/vibration generating means generates sound or vibration, it is possible to give a variety of changes and much more fun. When the liquid crystal front display makes a line display along a scoring arrangement, it is easy to grasp the symbol arrangement as a prize winning combination and hence it is possible to make the game much more exciting.

We claim:

1. A slot machine having a housing in which a plurality of symbols is to be changed on a symbol display by inserting tokens into a slot and activating a game start switch and then to be stopped in timed relation with activations of respective stop switches, said slot machine comprising:

a plurality of liquid crystal front displays each situated in front of the respective symbol display and partially changeable between shielding light and transmitting light to create a flowing longitudinal movement of the symbols; and front display controlling means for controlling each of said plurality of liquid crystal front displays to make a predetermined display, wherein a prize winning display on the liquid crystal front display is unobstructed by areas between the symbol display areas of said housing.

2. A slot machine according to claim 1, further comprising:

result discriminating means for discriminating whether or not the combination of stopped symbols coincides with the prize winning combination set by said prize winning combination setting means; and said front display controlling means being capable of controlling said liquid crystal front displays to make the predetermined display when the combination of stopped symbols coincides with the prize winning combination as discriminated by said result discriminating means.

3. A slot machine according to claim 2, wherein said liquid crystal front displays are capable of additionally displaying flashing frames encircling positions corresponding to the respective symbols of the prize winning combination as discriminated by said result discriminating means.

4. A slot machine according to claim 2, wherein said front display controlling means is capable of controlling each said liquid crystal front display to display a plurality of the symbols simultaneously, said prize winning combination being a combination of symbols arranged in a straight line over said crystal displays, wherein said liquid crystal front displays are capable of additionally displaying the straight line on which the symbols of the prize winning combination are arranged.

5. A slot machine according to claim 1, further comprising:

each said liquid crystal front display being capable of displaying a plurality of the symbols simultaneously;

an identifying unit for identifying whether the token inserted into the slot is genuine or not;

prize winning combination setting means for setting a prize winning combination, from a plurality of predetermined combinations of symbols to be arranged in the straight line, depending on the number of inserted tokens identified as being genuine by said discriminating unit;

result discriminating means for discriminating whether or not the combination of stopped symbols coincides with the prize winning combination set by said prize winning combination setting means;

prize token dispensing means for dispensing tokens as a prize when said result discriminating means discriminates the coincidence of the combination of stopped symbols with the prize winning combination; and said front display controlling means being capable of controlling said liquid crystal displays to display a line in which the stopped symbols of the prize winning combination set by said prize winning combination setting means.

6. A slot machine according to claim 1, further comprising means for generating sound or vibration in response to the discrimination of said result discriminating means.

7. A slot machine for dispensing a prize when a combination of symbols coincides with one of a plurality of predetermined prize winning combinations, comprising:

a housing having a slot to receive tokens, a game start switch, a plurality of game stop switches and a plurality of elongated display areas;

a plurality of liquid crystal displays to longitudinally display a plurality of symbols in the corresponding display areas of said housing;

a display controlling means for controlling said plurality of liquid crystal displays to display a combination of symbols in each of said plurality of display areas;

a result discrimination means for determining whether to dispense the prize when the combination of symbols coincides with one of the plurality of prize winning combination;

a liquid crystal front display covering each of said plurality of liquid crystal displays; and a front display controlling means for controlling the display of said liquid crystal front display, wherein said display controlling means changing said plurality of symbols longitudinally displayed by the liquid crystal display of the corresponding elongated display area to simulate a flowing longitudinal movement of the symbols in response to an activation of said game start switch, and said display controlling means stopping the flowing longitudinal movement simulated by changing the symbols displayed by the liquid crystal display in the corresponding elongated display area in response to activations of a corresponding stop switch, and said front display controlling means displays a prize winning display on said liquid crystal front display when said result discriminating means determines to dispense the prize wherein the prize winning display on the liquid crystal front display is unobstructed by areas between the display areas of said housing.

8. A slot machine according to claim 7, wherein each of said plurality of liquid crystal displays has a front convex surface to form a drum shape surface within each of said plurality of elongated display areas.

9. A slot machine according to claim 8, wherein each said liquid crystal display includes a plurality of liquid crystal display plates connected to one another at an angle.

10. A slot machine according to claim 7, further comprises means for generating sound or vibration in response to the discrimination of said result discriminating means.

11. A slot machine as defined in claim 7, further comprising:

an identifying unit for identifying whether a token inserted into the slot is genuine or not;

prize winning combination setting means for setting a prize winning combination from a plurality of predetermined combinations of symbols to be arranged in the straight line, depending on the number of inserted tokens identified as being genuine by said identifying unit; and prize token dispensing means for dispensing tokens as the prize when said result discriminating means discriminates the coincidence of the combination of stopped symbols with the prize winning combination.

* * * * *